United States Patent [19]

Iwans

[11] Patent Number: 4,497,179

[45] Date of Patent: Feb. 5, 1985

[54] ICE BANK CONTROL SYSTEM FOR BEVERAGE DISPENSER

[75] Inventor: Robert C. Iwans, Sinsbury, Conn.

[73] Assignee: The Coca-Cola Company, Atlanta, Ga.

[21] Appl. No.: 583,517

[22] Filed: Feb. 24, 1984

[51] Int. Cl.[3] ..... F25C 1/00

[52] U.S. Cl. ..... 62/59; 62/139

[58] Field of Search ..... 62/59, 68, 138, 139

[56] References Cited

U.S. PATENT DOCUMENTS

| | | | |
|---|---|---|---|
| 2,685,952 | 8/1954 | Hamlin et al. | 62/138 X |
| 3,496,733 | 2/1970 | Parker et al. | 62/139 |
| 4,008,832 | 2/1977 | Rodth | 62/138 X |
| 4,011,133 | 3/1977 | Kuckens et al. | 62/139 X |
| 4,124,994 | 11/1978 | Cornelius | 62/138 |
| 4,437,319 | 3/1984 | Iannelli | 62/138 |

*Primary Examiner*—William E. Tapolcai

[57] ABSTRACT

An ice bank control system for a beverage dispenser for preventing the unnecessary erosion of the ice bank when the dispenser is idle or inactive, and for thus increasing the draw capacity of the dispenser. The control system includes a pair of ice bank sensors for sensing first and second locations of the surface of the ice bank, the second sensor being spaced further from the cooling coils than is the first sensor. Each sensor generates an electrical signal which, through appropriate electrical control circuitry, controls the on/off mode of the electrical motor that drives the water agitator and also the electrical motor that operates the refrigeration unit.

18 Claims, 5 Drawing Figures

ICE BANK CONTROL SYSTEM FOR BEVERAGE DISPENSER

BACKGROUND OF THE INVENTION

1. Field of the Invention

This invention relates to beverage dispensers using mechanical refrigeration systems to produce an ice bank in an ice water bath to cool the syrup and water tubes, and more particularly to a system for preventing the unnecessary erosion of the ice bank when the dispenser is idle or inactive, and thus for increasing the draw capacity of the dispenser.

2. Description of the Prior Art

Current beverage dispensers using a refrigeration unit to produce an ice bank in an ice water bath employ an agitator which operates continuously or which operate based on timed on/off cycles regardless of use. These dispensers unnecessarily shear the ice and release its latent heat to atmosphere or to other heat sinks resulting in misshapen and smaller ice banks, thus reducing the draw capacity of the dispensers.

It is an object of the present invention to provide an ice bank control system which solves the above-mentioned problems in current dispensers.

It is another object of this invention to provide a method and apparatus for controlling the operation of the agitator and of the mechanical refrigeration unit to prevent unnecessary erosion of the ice bank and to increase the draw capacity of the dispenser.

It is a further object of this invention to sense the build-up of the ice bank between two positions and to provide electrical signals which are then used to control the operation of the agitator and of the refrigeration unit.

It is another object of this invention to provide an override mode of operation, to measure the total amount of time the dispensing valves are on since the agitator was last turned off, and to then turn on the agitator when the total amount of time reaches a particularly valve.

It is another object of this invention to provide this control logic with minimum componentry and expense and with high reliability.

SUMMARY OF THE INVENTION

An ice bank control system for a beverage dispenser for preventing unnecessary erosion of the ice bank when the dispenser is idle or inactive. The control system includes a plurality of ice bank sensors. A first sensor detects the surface of the ice bank at a first location as the ice bank is formed. A second sensor subsequently detects the surface of the ice bank as it continues to grow, at a second location further away from the cooling coils of the refrigeration unit.

Each sensor generates an electrical signal through appropriate control circuitry which controls the on/off mode of an electrical motor that drives the agitator.

The on/off mode of the agitator is controlled such that prior to said first sensor detecting the surface of the ice bank, the agitator is held in an off mode. When the signal is received from the first sensor, the control system then initiates an "on-off" mode for the agitator during which the agitator alternates between "on" and "off" modes for equal periods of time (preferably approximately three minutes "ON" and three minutes "OFF"). The time periods are controlled by timers which are part of the electrical control circuitry.

When said second sensor detects the ice bank surface, that is, when a signal is received from the second sensor, the agitator is turned "OFF", and, in addition, the refrigeration unit is also turned "off" thus, preventing further build-up of the ice bank.

An override circuit in the ice bank control system causes the agitator to go to the "ON" mode regardless of the signal condition caused by the ice bank sensors, when a certain condition occurs. The override circuit is comprised of a summing circuit which accumulates the time any one or any combination of the dispensers valves has been open, since the agitator was last turned off. When the accumulated time reaches a preset level (preferably approximately 40 seconds, which time preferably represents approximately 60 oz. of product), the agitator is turned "ON" for a present time (preferably about one minute).

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
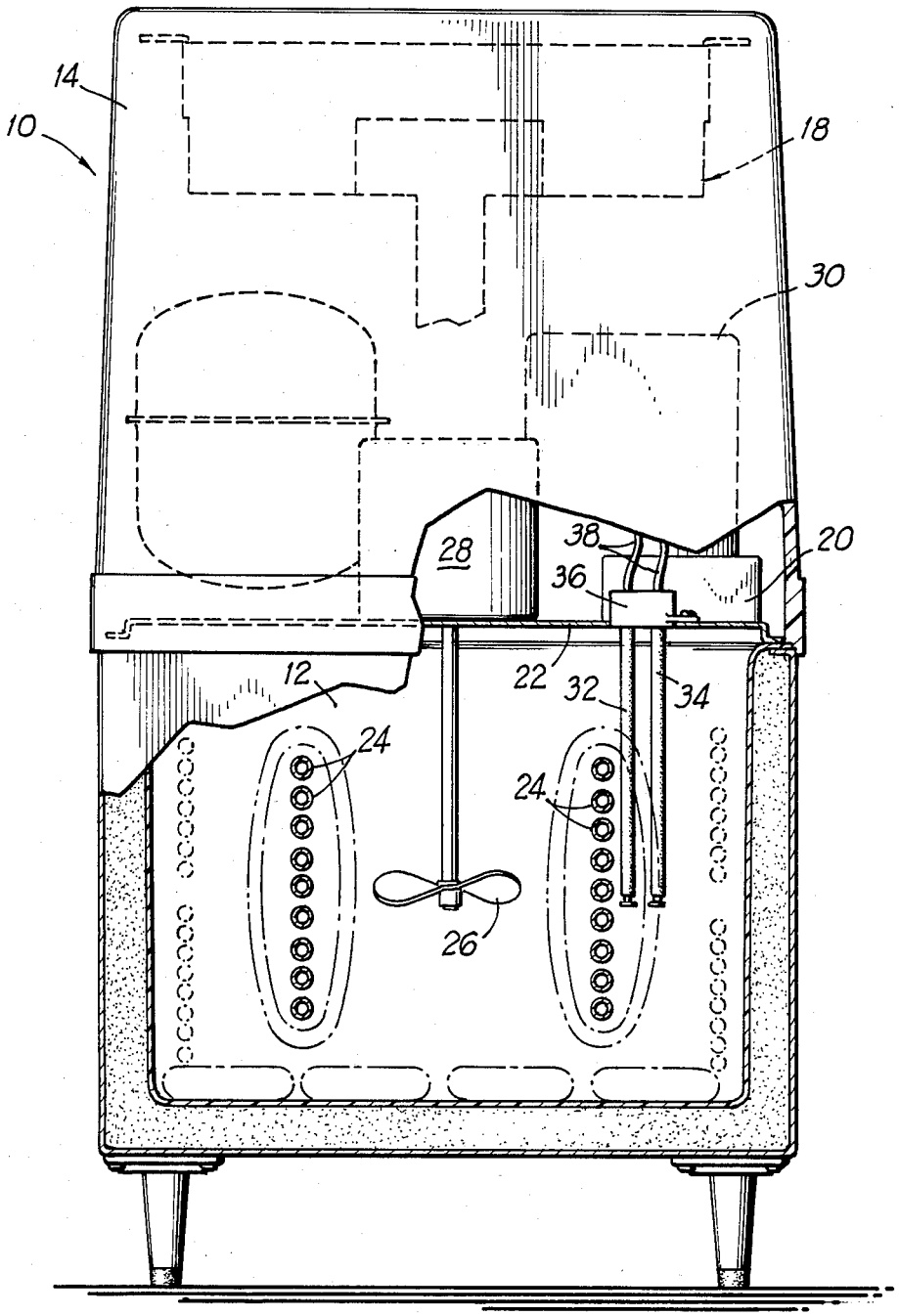
FIG. 1 is a partly broken away view of a beverage dispenser having the ice bank sensors and control system of the present invention.

With reference now to the drawings, FIG. 1 shows a beverage dispenser 10 having a housing including a tank 12 and a shroud 14, a plurality of dispensing valves 16, a mechanical refrigeration unit 18 and an ice bank control system 20.

The refrigeration unit 18 includes a support plate 22 resting on the tank 12 and cooling coils 24 that extend down below the plate 22 and produce an ice bank (see the dotted lines) in an ice water bath in the tank 12 used to cool the water and syrup tubes (not shown) located in the ice water bath. The refrigeration unit 18 also includes an agitator 26, driven by an electric motor 28 for circulating the water surrounding the ice bank to cause the ice bank to shear and release its latent heat, thereby cooling the water and syrup tubes which are submerged in the water surrounding the ice bank. The refrigeration unit 18 also includes an electric motor 30 for operating the refrigeration unit.

Figure 5:
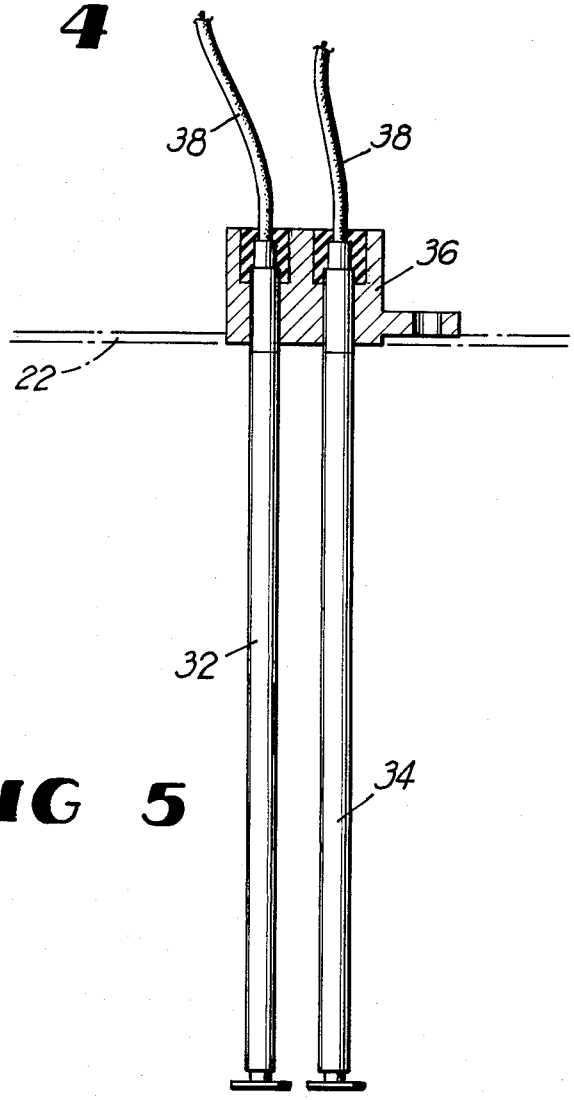
FIG. 5 is a partly schematic, partly cross-sectional view of the sensors used in the present invention.

The control system 20 of the present invention includes a first sensor 32 and a second sensor 34, both of which extend down from the plate 22 adjacent the cooling coils 24. The first sensor 32 is located closer to the cooling coils than is the second sensor 34. The two sensors may depend from a single probe holder 36 (see FIG. 5). Electrical wires 38 extend from each probe to a control circuit mounted in a housing above the plate 22.

The first sensor 32 detects the surface of the ice bank as the bank forms and reaches the location of the first sensor 32. The second sensor 34 subsequently detects the surface of the ice bank as the ice bank continues to form and reaches the location of the second sensor 34. When the ice covers a sensor, an electrical signal is generated. The electrical signals generated by the sensors are used by the control system 20 to control the on-off mode of the agitator 26 by turning the motor 28 on and off, and also to control the on-off mode of the refrigeration unit 18 by turning the motor 28 on and off.

Figure 2:
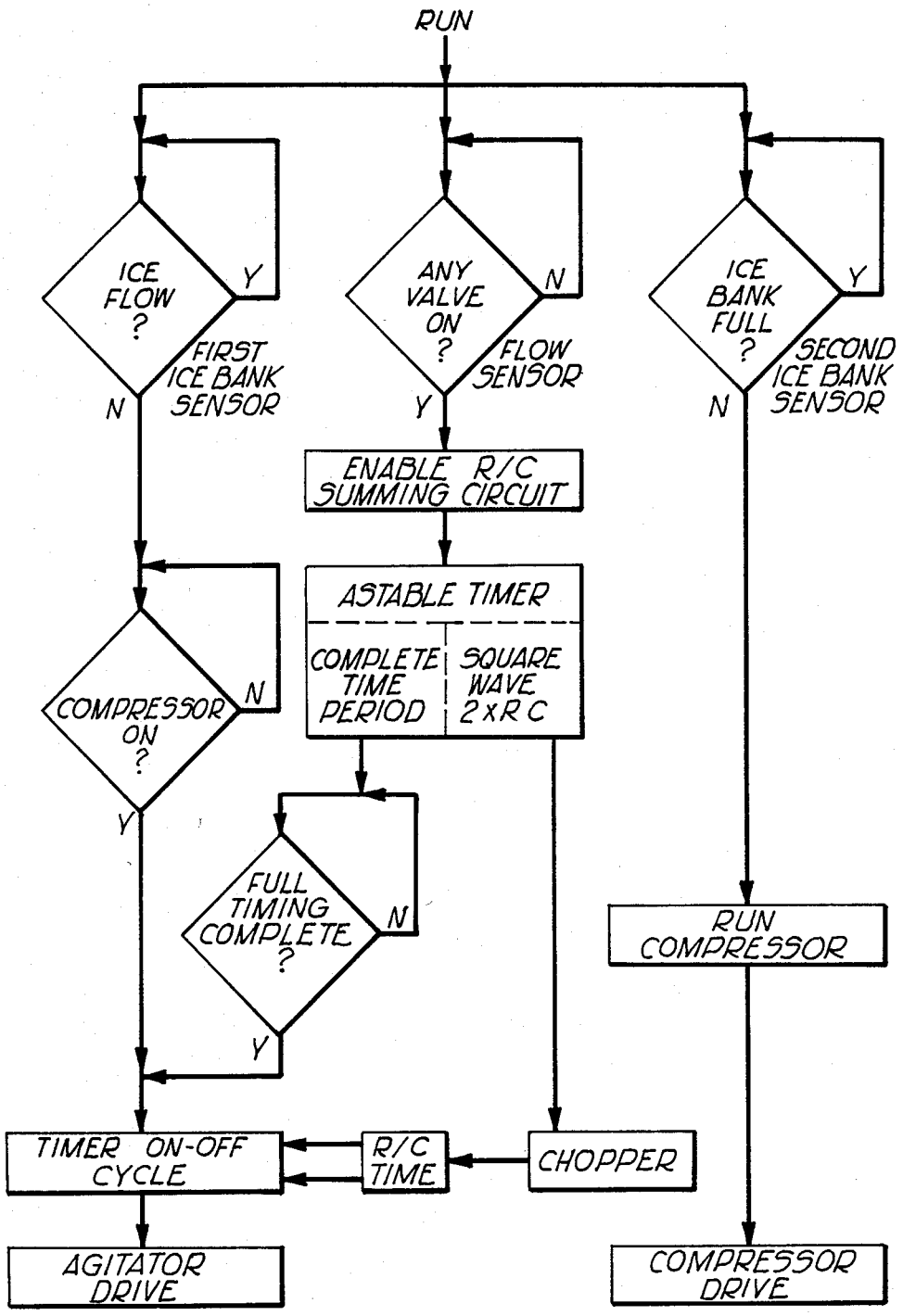
FIG. 2 is a logic flow chart of the present invention.
Figure 3:
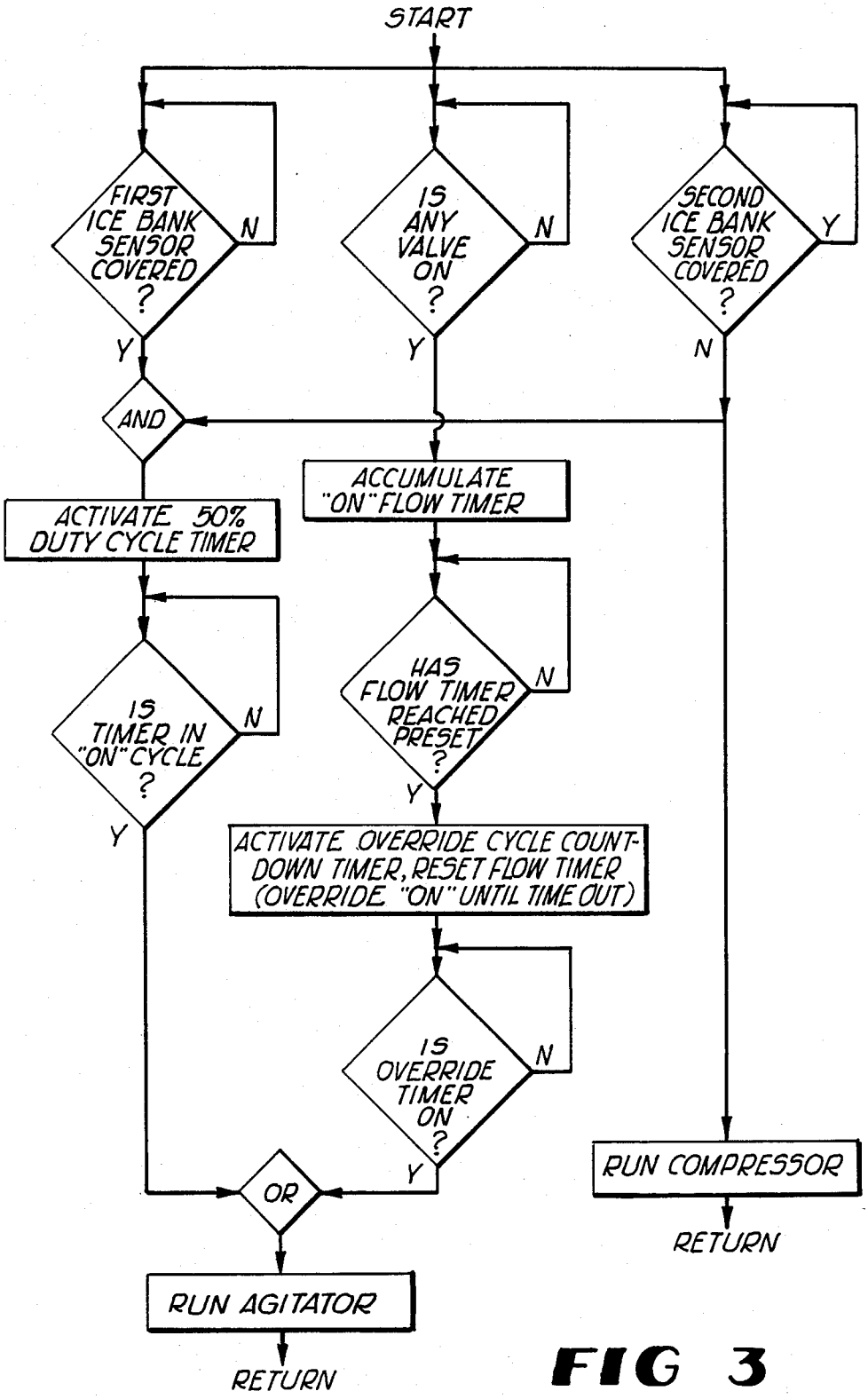
FIG. 3 is another logic flow chart of the invention.
Figure 4:
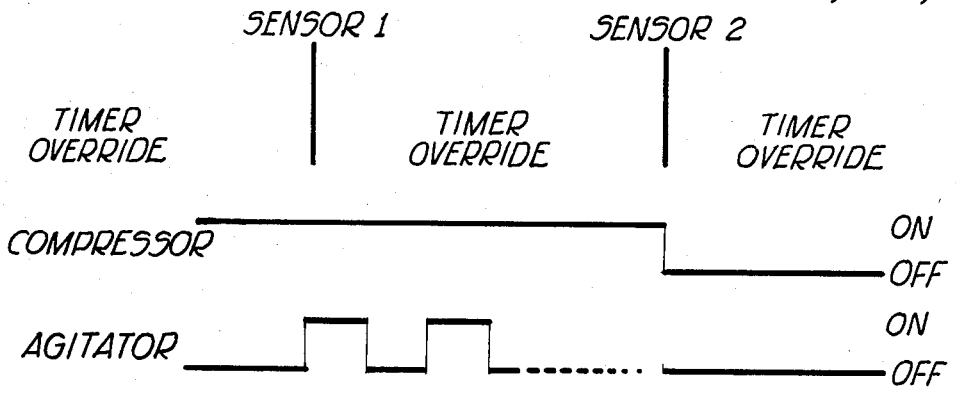
FIG. 4 is diagram illustrating the on-off cycles of the agitator and the compessor.

As will be understood by one skilled in the art from the logic flow charts in the drawings, the on-off mode of the agitator 26 is controlled such that prior to the first sensor 32 detecting the surface of the ice bank, the agitator is held in an "off" mode. Upon receiving a signal from the first sensor 32, the agitator is then operated on "on-off" mode. Preferably the "on" and "off" periods of times are equal, and preferably each period of time is approximately three minutes long. These periods of time are controlled by timers which are part of the control circuitry of FIG. 2.

Upon receiving a signal from the second sensor 34, that is, when the surface of the ice bank contacts the second sensor 34, the agitator 26 is then turned off, and the motor 34 for the refrigeration unit 18 is also turned off to prevent further build-up of the ice bank.

The control system 20 also includes an override circuit to cause the agitator to go to the "on" mode regardless of the signal condition caused by the two sensors 32 and 34. The override circuit is comprised of a summing circuit which accumulates the total time that any one or any combination of the dispenser valves 16 have been open since the agitator 26 was last turned off. When the accumulated time reaches a preset value (preferably approximately 40 seconds, or the time required to dispense about 60 ounces of syrup), the agitator 26 is turned on for a particular time (preferably about one minute).

It should, thus, be apparent that various alterations, modifications, and changes may be made in the preferred embodiment illustrated herein without departing from the spirit and scope of the present invention as defined in the appended claims.

What is claimed:

1. A method for increasing the draw capacity of a beverage dispenser having at least one dispensing valve and having a mechanical refrigeration unit including cooling coils and an agitator for producing an ice bank in an ice-water bath, comprising the steps of:

(a) sensing when a surface of the ice bank has reached a first location and generating a first electrical signal at that time;

(b) sensing when a surface of the ice bank has reached a second location further from the cooling coils than is said first location and generating a second electrical signal at that time;

(c) maintaining said agitator off prior to receiving said first signal;

(d) operating said agitator in an on-off mode after receiving said first signal;

(e) upon receiving said second signal, operating both said agitator and said mechanical refrigeration unit in an off mode, to prevent further build-up of the ice bank; and (f) upon subsequently receiving said first signal again, turning on said mechanical refrigeration unit and also initiating said on-off mode of operation of said agitator.

2. The method as recited in claim 1 wherein the on and off periods of said on-off mode are equal periods of time.

3. The method as recited in claim 2 wherein said equal periods of time are approximately three minutes long.

4. The method as recited in claim 3 including controlling said periods of time with timers.

5. The method as recited in claim 1 including turning said agitator on, regardless of the signal condition of the sensing signals, whenever the total amount of time during which any combination of dispensing valves has been open since the agitator was last turned off, has reached a predetermined quantity.

6. The method as recited in claim 5 wherein said step of turning on said agitator includes turning on said agitator only for a period of time.

7. The method as recited in claim 6 wherein said period of time is approximately one minute.

8. The method as recited in claim 5 when said total amount of time is approximately 40 seconds.

9. The method as recited in claim 5 including adding up all of the time during which each dispensing valve has been opened since the agitator was last turned off.

10. The method as recited in claim 1 wherein said first location sensing step comprises positioning a first sensor adjacent the cooling coils such that said sensor will contact the surface of an ice bank.

11. The method as recited in claim 10 wherein said second location sensing step comprises positioning a second sensor adjacent the cooling coils but spaced further therefrom than is said first sensor such that said second sensor will contact the surface of an ice bank.

12. An ice bank control system for a beverage dispenser having at least one dispensing valve and having a mechanical refrigeration unit including cooling coils and an agitator for producing an ice bank in an ice-water bath comprising:

(a) a first sensor located adjacent to said cooling coils;

(b) a second sensor located adjacent to but spaced further apart from said cooling coils than is said first sensor;

(c) means for generating a first electrical signal when said first sensor is covered with ice;

(d) means for generating a second electrical signal when said second sensor is covered with ice;

(e) means for maintaining said agitator off prior to receiving said first signal;

(f) means for operating said agitator in an on-off mode after receiving said first signal;

(g) means for turning off both said agitator and said mechanical refrigeration unit upon receiving said second signal, for preventing further build up of the ice bank; and (h) means, upon subsequently receiving said first signal again, for turning on said mechanical refrigeration unit and also for initiating said on-off mode of operation of said agitator.

13. The ice bank control system as recited in claim 12 wherein the on and off periods of said on-off mode are equal periods of time.

14. The ice bank control system as recited in claim 13 wherein said equal periods of time are approximately 3 minutes long.

15. The ice bank control system as recited in claim 14 including timer means for controlling said periods of time.

16. The ice bank control system as recited in claim 12 including means for turning said agitator on, regardless of the signal condition of the sensor signals, whenever the total amount of time during which any combination of dispensing valves has been open since said agitator was last turned off, has reached a predetermined valve.

17. The ice bank control system as recited in claim 16 wherein said means for turning on said agitator includes means for turning on said agitator only for a period of time.

18. The ice bank control system as recited in claim 12 including means for adding up all of the time during which each dispensing valve has been opened since said agitator was last turned off.

* * * * *